United States Patent [19]

Chabries et al.

[11] Patent Number: 5,029,217

[45] Date of Patent: Jul. 2, 1991

[54] DIGITAL HEARING ENHANCEMENT APPARATUS

[75] Inventors: Douglas M. Chabries, Woodland Hills; Robert Brey, Orem, both of Utah; Martin Robinette, Rochester, Minn.; Richard W. Christiansen, Highland, Utah; Gary R. Kenworthy, Fremont, Calif.

[73] Assignees: Harold Antin; Mark Antin, both of New York, N.Y.

[21] Appl. No.: 331,953

[22] Filed: Apr. 3, 1989

Related U.S. Application Data

[63] Continuation-in-part of Ser. No. 820,632, Jan. 21, 1986, abandoned.

[51] Int. Cl.[5] ..... H04R 25/00

[52] U.S. Cl. ..... 381/68.2

[58] Field of Search ..... 381/68.2, 68.4

[56] References Cited

U.S. PATENT DOCUMENTS

| | | | |
|---|---|---|---|
| 3,894,195 | 7/1975 | Kryter | 381/68.2 |
| 4,099,035 | 7/1978 | Yanick | 381/68.2 |
| 4,419,544 | 12/1983 | Adelman | 381/68.2 |
| 4,536,844 | 8/1985 | Lyon | 381/68.2 |
| 4,630,302 | 12/1986 | Kryter | 381/94 |
| 4,658,426 | 4/1987 | Chabries et al. | 381/94 |

*Primary Examiner*—Forester W. Isen

*Attorney, Agent, or Firm*—G. Donald Weber, Jr.

[57] ABSTRACT

An apparatus and technique for enhancing the hearing capabilities of persons by providing a device which is a model of the desired hearing characteristic of the persons.

18 Claims, 4 Drawing Sheets

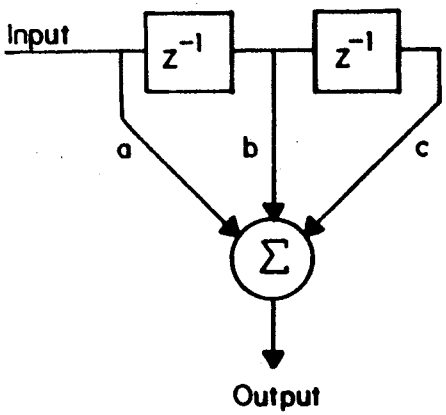
FIG. 6A
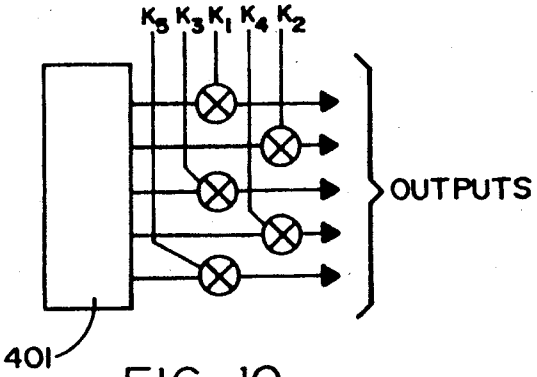
FIG. 10
FIG. 8
FIG. 9
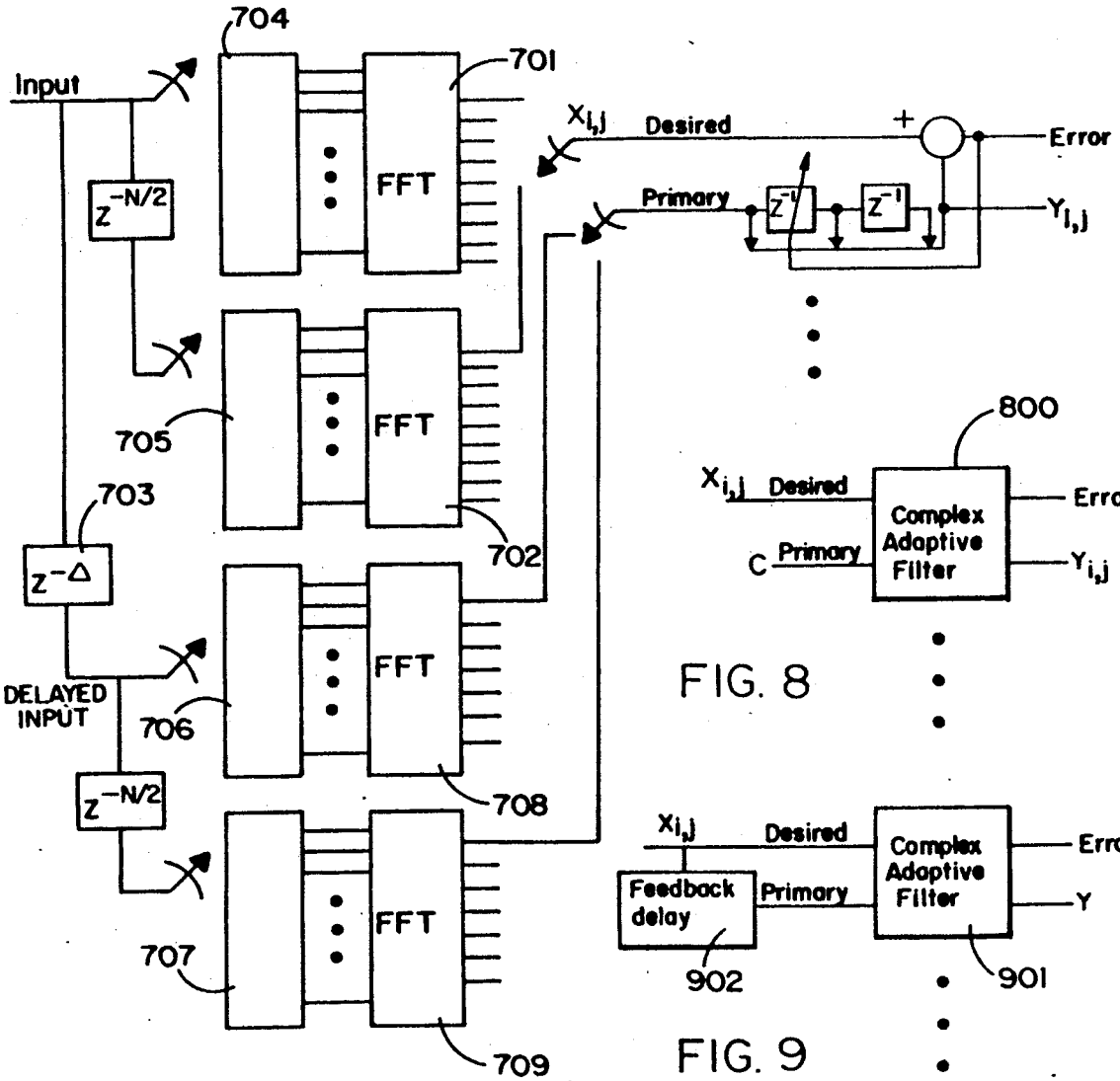
FIG. 7

DIGITAL HEARING ENHANCEMENT APPARATUS

This is a continuation-in-part of application Ser. No. 06/820,632, filed Jan. 21, 1986, now abandoned.

BACKGROUND OF THE INVENTION

1. Field of the Invention

This invention is directed to systems and devices which are useful in, the improvement of hearing ability of an individual, in general, and, more particularly, to methods and apparatus for providing improvement in hearing and spatial processing of sound by improving the discernment of sound in the "perceptual space" of the individual.

2. Prior Art

It is currently recognized by the public at large that hearing impairment is a serious problem. However, this problem has, generally, not received the same attention as other diseases, maladies or impairments. Typically, the reason for the lack of attention is that hearing impairment is the "silent handicap". That is, it is not as readily apparent to the public as are other physical handicaps. In fact, many hearing impaired individuals are unaware of their loss until tested or confronted with a specialized circumstance. Nevertheless, impaired hearing can have a significant impact on the quality of life of the individual involved. Therefore, it has been a source of investigation by many researchers (of various levels of ability) over the years to produce hearing enhancements or "hearing aids". These "aids" are available at various levels of technical expertise.

One type of hearing aid available on the market uses noise supression techniques. However, conventional filtering techniques generally are not considered to be effective or adequate for providing truly high fidelity frequency compensation which is desirable in hearing aids. Thus, results from implementation of these techniques often suffer from muffled sound outputs, as well as unacceptable noise and ringing problems.

A further problem in the conventional design of hearing aids is the inadequate treatment of background noise. Thus, a related problem with conventional hearing aid design is that the user will normally reduce the volume to reduce the higher intensity energy produced, for example, by vowels. However, at the same time the user sacrifices speech intelligibility by simultaneously reducing the intensity of the lower energy signals, e.g., sounds produced by consonants. Further, hearing aids which employ automatic gain control (i.e., gain decreases as input level increases) have the disadvantage of decreasing the gain as a function not only of the lower frequency, stronger vowel sounds contained in speech but also by the large energy, low frequency background noises. Because background noise and vowels can have the same effect on the gain control, an abnormal relationship between speech sounds is introduced. High frequency consonants, for example, are not amplified sufficiently in the presence of background noises thereby resulting in greatly reduced speech intelligence. In conventional hearing aid systems all sounds are amplified whereupon background noises greatly mask speech intelligibility.

It is well known from Bekesy's model of the ear that predominantly low frequency noise masks the higher frequency consonants because of the travelling wave phenomenon of the basilar membrane. Thus, low frequency information masks high frequency information. However, the reverse is not true. This phenomenon is commonly referred to in the literature as the "upward spread" of masking.

A particularly troublesome area for the hearing impaired individual occurs during normal conversation in an environment of a conference or large office. Persons with normal hearing are able to selectively listen to conversations from just one other person. The hearing impaired person has no such ability and, thus, the individual experiences a phenomenon known as a "cocktail party effect" in which all sounds are woven into an undecipherable fabric of noise and distortion. This condition is aggravated for the hearing impaired because all incoming sounds have a single point source at the output transducer of the conventional hearing aid. Under these circumstances, speech itself competes with noise and the hearing impaired person is constantly burdened with the mental strain of trying to filter out the sound he or she wishes to hear. The result is poor communication, frustration and fatigue.

Yet another performance shortcoming of the conventional hearing aid, particularly in "open mold" hearing aid fittings, resides in the area of audio feedback. The amplified signal is literally routed back to the hearing aid input microphone and passes through the amplification system repeatedly so as to produce an extremely irritating whistling or ringing. While feedback may be controlled in most fixed listening situations, it has not been controllable for the hearing aid user who faces a changing acoustic environment.

Another area of hearing impairment, related to background noise, is experienced in many noisy environments. These environments include industrial locations, office areas, computer rooms, airport pad locations, to name just a few. In these environments, even persons with so-called "normal" hearing may experience difficulty in understanding and/or discerning sounds, whether vocal or otherwise. That is, normal conversation is impossible and persons must shout to each other merely to be heard. Moreover, in many of these environments (especially industrial or airport locations), persons wear ear protectors to prevent damage to the ears. In fact, in some instances, such ear protection devices are mandated by law.

In these cases, a standard hearing aid is of little or no advantageous consequence, for the reasons discussed above. However, it is highly desirable to have some type of hearing enhancement device or apparatus for use in these situations for comfort, convenience and/or safety.

CROSS-REFERENCE

Reference is hereby made to the copending application entitled DIGITAL HEARING AID UTILIZING FILTER BANK STRUCTURE, by Douglas M. Chabries, et al, now U.S. Pat. No. 4,658,426 which is incorporated herein in its entirety including the prior art citations and references.

PRIOR ART PATENTS

Reference is made to the following U.S. Patents which are considered to be of interest. These patents are listed in Patent No. order without any attempt at ranking in importance.

U.S. Pat. No. 4,238,746; ADAPTIVE LINE ENHANCER; McCool et al.

U.S. Pat. No. 4,349,889; NON-RECURSIVE FILTER HAVING ADJUSTABLE STEP-SIZE FOR EACH ITERATION; van den Elzen, et al.

U.S. Pat. No. 4,243,935; ADAPTIVE DETECTOR; McCool et al.

U.S. Pat. No. 4,052,559; NOISE FILTERING DEVICE; Paul et al.

U.S. Pat. No. 4,038,536; ADAPTIVE RECURSIVE LEAST MEAN SQUARE ERROR FILTER; Ferntuch.

U.S. Pat. No. 3,375,451; ADAPTIVE TRACKING NOTCH FILTER SYSTEM; Borelli et al.

U.S. Pat. No. 4,302,738; NOISE REJECTION CIRCUITRY FOR A FREQUENCY DISCRIMINATOR; Cabot et al.

U.S. Pat. No. 4,480,236; CHANNELIZED SERIAL ADAPTIVE FILTER PROCESSOR; Harris.

U.S. Pat. No. 4,548,082; HEARING AIDS, SIGNAL SUPPLYING APPARATUS, SYSTEMS FOR COMPENSATING HEARING DEFICIENCIES AND METHODS; Engebretsen et al.

U.S. Pat. No. 4,489,610; COMPUTERIZED AUDIOMETER; Slavin

U.S. Pat. No. 4,188,667; ARMA FILTER AND METHOD FOR DESIGNING SAME; Graupe, et al U.S. Pat. No. 4,099,035; HEARING AID WITH RECRUTMENT COMPENSATION; Yanick.

U.S. Pat. No. 4,471,171; DIGITAL HEARING AID AND METHOD; Kopke et al.

OTHER PUBLICATIONS:

Crochiere, R. E., and Rabiner, L. R.; *Multirate Digital Signal Processing*, Prentice-Hall Inc., Englewood Cliffs, N.J., 1983 (see especially Chapter 7).

Papoulis, A.; *Signal Analysis*, McGraw Hill, 1977 (see especially pages 176–178).

Stevens, S. S. and Davis, H.; *Hearing: Psychology and Physiology*, John Wiley and Sons, 1938, (Page 134).

Fletcher and Munson; *Journal of the Acoustical Society of America*, Sept. 1, 1937.

SUMMARY OF THE INVENTION

This invention is directed to a method and apparatus for improving the hearing capability of persons with some type of impaired hearing, whether implicit or imposed. The invention comprises a system which empirically detects the portions of a person's hearing which are impaired. The hearing aid system is then particularly selected to enhance those impaired portions. This may include a reduction in some impairments which are in the nature of over sensitive hearing capability. The entire process and apparatus of this invention is directed at enhancing the overall hearing capability of the person in that person's "perceptual space", thereby to produce an improved hearing signal at the auditory nerve. The invention does not merely amplify all sounds.

The invention provides for noise suppression, feedback suppression, frequency compensation and recruitment. These improvements can be supplied together or separately and in any order. By using all of these improvements, the optimum signal can be obtained. However, a lesser signal can be produced by using less than all of the improvement techniques.

The invention uses a transmultiplexer which, essentially, separates the incoming signal into a plurality of bands. These bands are then operated upon separately. Appropriate suppression is achieved by adaptive filters, multiplication circuits or the like. Other operations such as taking the log and the exponential of the signals are used to "map" the prescribed apparatus for the individual aid. The several bands are then recombined to produce the output signal which is supplied to the individual.

In the context of this description, the phrase "hearing aid" or "hearing enhancement device" is intended to include an apparatus or device which is used to enhance the hearing capabilities of a person within his (or her) environment. It includes but is not limited merely to devices for assisting those persons with individual hearing impairments.

BRIEF DESCRIPTION OF THE DRAWINGS

FIG. 6A is a schematic representation of a three-tap FIR filter which can be used with the instant invention.

FIG. 7 is a block diagram of a noise suppression device with a delay in the time domain.

FIG. 8 is a block diagram of a noise suppression device using a constant primary input value.

FIG. 9 is a block diagram of a feedback suppression device which can be used with the instant invention.

FIG. 10 is a schematic representation of one embodiment of a frequency compensation network which can be used with the instant invention.

DESCRIPTION OF A PREFERRED EMBODIMENT

Figure 1:
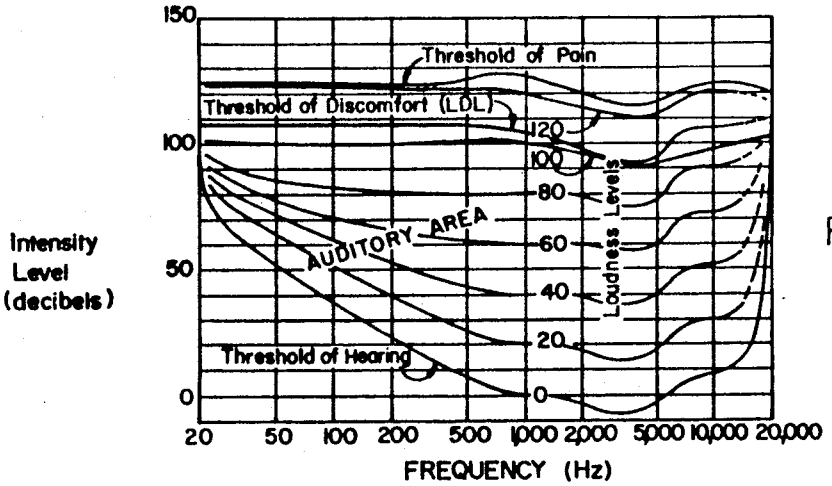
FIG. 1 is a graphic representation of an auditory area for a person with "average" hearing.

Referring now to FIG. 1, (see Stevens et al. noted above) there is shown a typical graphical representation of a "normal" hearing pattern for the "average" human ear. In particular, contours of equal loudness (phons) are plotted against the intensity level (in decibels) and frequency in Hz. In this instance, the contours are numbered by the equal loudness correspondence with the intensity level at 1000 Hz. It should be noted that the contours of equal loudness are, typically, spaced logarithmically and, hence, annotated in decibels (10 $\log_{10}$). The human hearing system must account for this nonlinearity.

In this graph, contour 0 is defined as the threshold of hearing. That is, below this intensity the normal human ear does not perceive sound. Thus, at 0 dB and 1000 Hz, a sound is just barely audible to the average person. On the other hand, at 50 dB and 1000 Hz the sound is well within the normal hearing range. Conversely, even at 40 dB, a 50 Hz signal normally is inaudible.

At the other end of the range, the upper contour is referred to as the threshold of pain. That is, the application of a signal of appropriate freqency at or above the designated decibel level will produce discomfort (pain) and, perhaps, damage to the ear. It is seen that this threshold of pain remains fairly constant at a level of approximately 125 dB.

However for hearing aid fitting, a "loudness discomfort level" (LDL) should be employed as an upper limit for hearing aid output rather than a threshold of pain. By following this approach, it is possible to avoid actual pain or discomfort (in the hearer) due to loudness, the introduction of non-linear distortion by overdriving the basilar membrane, and/or physical damage to the parts of the inner ear.

Figure 1A:
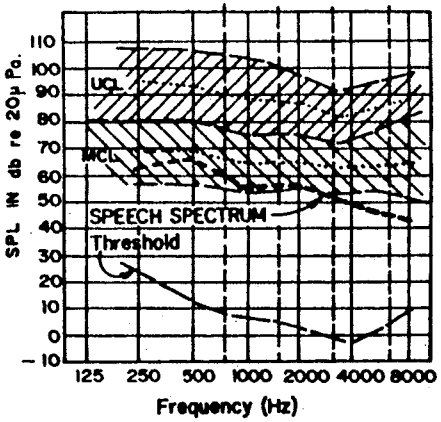
FIG. 1A is another graphic representation of the dynamic range of "normal hearing" persons as measured in response to pulsed narrow bands of sound.

FIG. 1A shows a graphic presentation of the sound pressure level (SPL) vs. frequency. FIG. 1A also shows the mean and the range for comfortable (MCL) and uncomfortable listening levels (UCL) for pulsed narrow band noise. Subtracting the threshold levels from the upper range for the UCL, provides the dynamic range of hearing for "normal" hearing persons. Thus, between 250 and 8000 Hz the dynamic range is between about 80 and 95 dB.

However, it has been determined that in many instances of hearing impairment, this dynamic range is significantly altered. Impairment of hearing occurs when the threshold of hearing for an individual is, effectively, raised. Thus, the dynamic range for that individual is reduced and possibly distorted. Moreover, it may be that the threshold of hearing is increased uniformly as a function of frequency. If the threshold of hearing is, in fact, increased uniformly across frequency, the typical approach to hearing aid construction, i.e., the mere amplification of the signals, will be beneficial. However, it is clear that even with a uniform increase of threshold of hearing, a uniform amplification will amplify both desired frequencies (where a hearing loss exists) and undesired frequencies (where hearing is normal). This operation is, of course, recognized as a critical problem with conventional hearing aids currently available.

However, it is recognized that the hearing impairment that is most typically encountered is not merely a uniform rise in the threshold of hearing. More typically, what occurs is an alteration in the shape of the threshold hearing contour wherein certain frequency ranges are not received as well, or at all. Thus, certain frequency ranges need to be enhanced and other frequency ranges need no adjustment.

It is the purpose of this invention to recognize that the human hearing system can be modeled as a non-linear process with measurable dynamic range and pass bands and, further, to provide a hearing aid which is programmable and which exploits this non-linear hearing model to compensate for each user's particular hearing loss in such a way as to reduce distortion, improve the signal-to-noise ratio, yield improved speech intelligibility in the presence of noise including speech babble, reduce or eliminate audio feedback and provide output between the threshold-of-hearing and the threshold-of-discomfort (LDL) contours for all frequencies. Similarly, the invention enhances loudness perception to the hearer.

Figure 2:
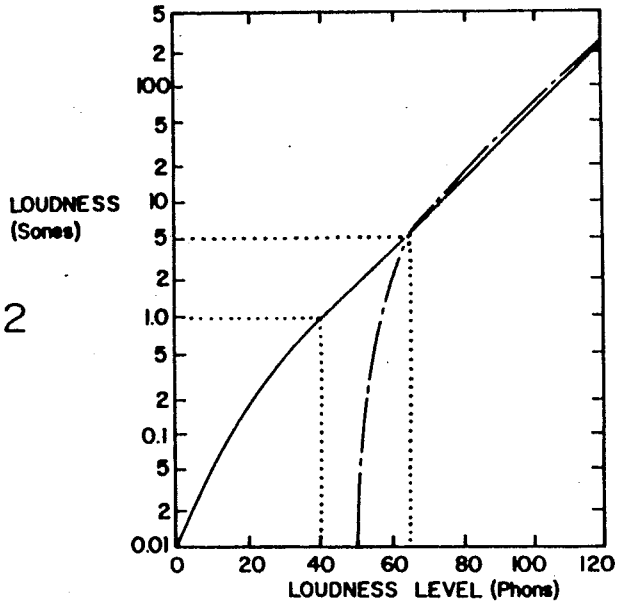
FIG. 2 is a graphic representation of the relationship between loudness (in sones) and loudness level (in phons) of a 1 KHz tone.

The relationship of loudness in sones to loudness in phons for the normal ear is shown as the solid line in FIG. 2. This is a log/log plot where 40 phons equals 1 sone. Recruitment, an abnormally rapid growth in loudness, is represented by the dot-dash line for an individual with a 50 dB hearing loss at 1 KHz. That is, this individual cannot hear below 50 dB. However, the loudness grows rapidly until at 65 dB and 5 sones the loudness perception of the person is equal to that of a normal hearing system. This non-linearity must be taken into account for the hearing impaired listener.

The type of hearing impairment which is encountered by different individuals varies. The conventional hearing aid which is currently available on the market is simply not adequate for all persons.

Figure 3:
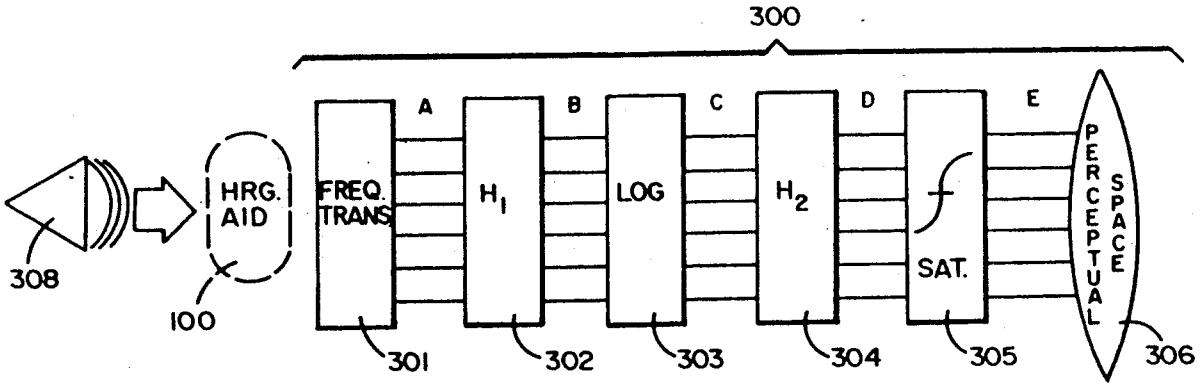
FIG. 3 is a block diagram of a model of a typical hearing operation.

Referring now to FIG. 3, there is shown a functional block diagram which is representative of a non-linear model of the hearing operation of the human hearing system 300. To better understand the operation of the hearing system 300, the following definitions are provided.

Frequency transducer 301 provides frequency transformation and separates the incoming sound, represented as a sequence of digital samples, into spectral bands, typically 16 to 32 in number. The bandwidth of the kth spectral band is denoted as BW(k). Conventional designs of this frequency transformation device are found in the literature (see for example, Papoulis, pages 176–178 or Crochiere et al, Chapter 7.) A particularly efficient implementation is shown and described relative to FIG. 5, infra.

Transfer function circuit 302 produces the transfer function $H_1$ wherein a value $H_1(k)$ is assigned to the kth output of frequency transducer 301. In this embodiment, $H_1(k)$ is a non-linear function of k which is obtained from the Fletcher-Munson contours of equal loudness as shown in FIG. 1. It should be noted that the contours in FIG. 1 are the desired responses for a "normal" hearing population and are not "fitted" to a particular individual. The value $H_1(k)$ is obtained by (1) selecting the frequency which corresponds to the index k; (2) reading the "Sound Pressure Level (SPL) (decibels)" from the ordinate of the chart in FIG. 1 as determined by the intersection of the selected frequency and the 0 dB "Loudness Levels" (also identified as "Threshold of Hearing (TOH)" and which can be considered to be the lower limit for the dynamic range; (3) calculating $H_1(k)$ by dividing the result of step (2) by −20; and (4) using the result of step (3) as an exponent for the number 10. This calculation is expressed in Eq. 1.

$$H_1(k) = 10^{\frac{SPL(\mathrm{dB})}{(-20)}} \qquad \text{Eq. 1.}$$

In Eq. (1), it is assumed that the input hearing aid transducer 100 has a response of unity as a function of frequency. If such is not the case, $H_1(k)$ must be further multiplied by the inverse of the gain factor of the transducer at the frequency of the corresponding spectral band.

The logarithm device 303 is a circuit wherein the logarithm to the base 10 is performed on each of the parallel inputs thereto (which are output bands of transfer function 302). Other bases of the logarithm may be chosen with appropriate modification the recruitment of $H_2(k)$ described infra. (It should be noted that multiplication of the recruitment function device 304 by $H_2(k)$ is an effective change of logarithmic base.)

In the recruitment function device 304, a value $H_2(k)$ is assigned to the kth output of logarithm device 303. The value $H_2(k)$ is a nonlinear function of k and is also obtained from the Fletcher-Munson contours of equal loudness for "normal" hearing populations shown in FIG. 1 supra. The value $H_2(k)$ is also obtained from FIG. 1 by (1) selecting the frequency which corresponds to the index k; (2) reading the "Sound Pressure Level (SPL) (decibels)" at the intersection of the selected frequency and the "Loudness Discomfort Level (LDL)" or other desired upper tolerance level value; (3) reading the "Sound Pressure Level (SPL) (decibels)" at the intersection of the selected frequency and the 0 db "Loudness Levels" (also marked "Threshold of Hearing"); (4) subtracting the result of step (3) from the result of step (2) and dividing this number into the desired "LDL" measured in decibels. This calculation is expressed in Eq. 2.

$$H_2(k) = \frac{LDL(\text{dB})}{SPL \text{ at } LDL - SPL \text{ at } TOH} \qquad \text{Eq. 2.}$$

The saturation circuit 305 operates on the outputs of recruitment function device 304. In particular, when the output of the kth channel of device 304 is less than zero (i.e., negative), the output of saturation circuit 305 for the kth channel is zero. When the output of the kth channel is greater than zero but less than the output of device 304 when the input to $H_1(k)$ is at "LDL" (saturation level, SL) the output of circuit 305 is equal to the output of the kth channel of 304. When the output of the kth channel of 305 device 304 is greater than the saturation level (SL), the output of the kth channel of circuit is set equal to the saturation level (SL).

The perceptual space 306 refers to the input of the afferent auditory nerve endings, in general, and to the signal which as been transformed by the model developed through operation of components 301, 302, 303, 304, and 305, in particular. In FIG. 3, the modeled auditory nerve input (which incidentially may be used to derive the signals to drive a cochlear implant by simple scaling) is for a "normal" hearing individual and is not fitted for a hearing impaired individual.

In this arrangement, sound is provided by a typical source 308 and received in the ear apparatus. The ear operates as a frequency transducer 301 which separates the incoming sound signal into a plurality of band pass output signals A. These band pass output signals are supplied to a transfer function 302 which operates to enhance the band pass output signals by increasing or decreasing the amplitudes of these signals in a non-linear fashion. In this way, the ear can selectively reject background, or noise, signals and concentrate on the desired signals.

The signals B from the transfer function 302 are provided to the log circuit 303 which performs a logarithmic (and therefore, non-linear) function thereon. The output C of the log function 303 is supplied to the recruitment function 304 which, effectively, scales the supplied signals as a function of frequency to produce an output with a dynamic and non-linear range which fits between the threshold-of-hearing and the threshold-of-discomfort (i.e., the dynamic range of the ear) for all hearing range frequencies.

The output D of the recruitment function 304 is supplied to the clipping or saturation function 305 which has the effect of cutting off extremely low and extremely high amplitudes by saturating. The output E of the clipping function 305 is provided in what is referred to as the "perceptual space" 306. This perceptual space is, for purposes of this discussion, defined as the signal space at the input ends of the afferent auditory nerve fibers. The effect that is produced by the hearing system is, essentially, the mapping of signals to the auditory nerve inputs, which will then simulate nerve firings or the like, which can then be detected as appropriate sounds.

For this invention, then, it is understood that the hearing operation and the impairment thereof is a function of the operation of one or more of the functions shown and described in the "dual" of the human hearing system shown in FIG. 3. For example, if the sensitivity function 302, the log function 303, the recruitment function 304, or the clipping function 305 is, in some way defective, a portion of the band pass signals supplied by the frequency transformation function 301 are lost, diminished, enhanced, or the like. This loss can be produced at signal level A, B, C, D or E. Any such deformation of the hearing function will, of course, produce an undesirable impairment of the hearing as detected at the perceptual space 306.

While the dual described above in relation to FIG. 3 is believed to be accurate, it is to be understood that modifications to this dual can be made by combining functions, separating functions, re-defining or fine-tuning functions, and so forth.

As shown in FIG. 3, a hearing enhancement device 100 can be interposed between the sound source 308 and the mathmatical model of human physiological hearing mechanism 300 which represents the human hearing system. This hearing enhancement device 100 is shown in dashed outline, to indicate that it is separate from the actual ear mechanism, and that it is supplied only in those instances where necessary.

It is presumed that when the hearing system 300 operates in the normal fashion (as suggested relative to FIGS. 1, 1A and 2), a hearing enhancement device 100 is not necessary. In the event that the hearing system 300 is not functioning properly, the hearing enhancement device 100 is inserted into the hearing processing channel.

Figure 4:
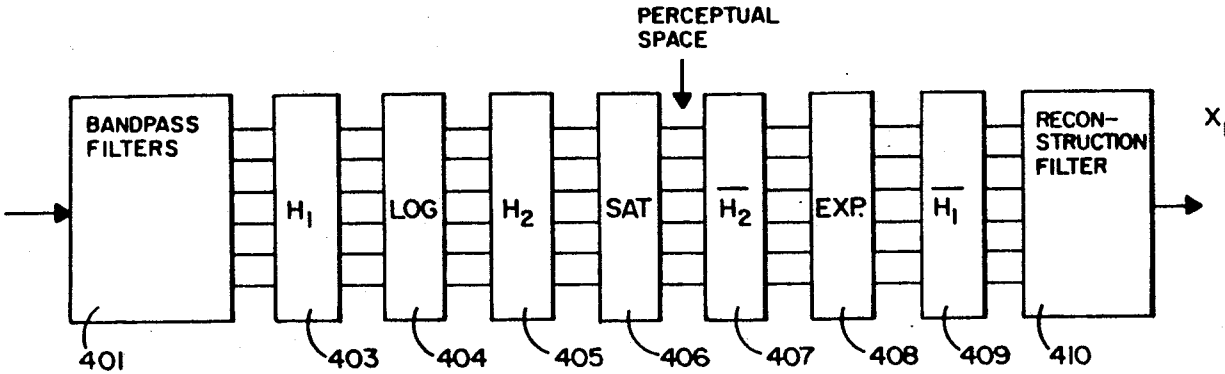
FIG. 4 is a block diagram of a model of the hearing enhancement device of the instant invention.

In the present invention, as best shown in FIG. 4, the hearing aid device 100 is used in an attempt to compensate for any deficiencies in the actual hearing mechanism 300. Thus, in a typical application, the individual is tested, in an empirical fashion, by applying sounds at various frequencies to the individual by means of an audiometer or the like. The results of these tests can produce a transfer characteristic for the ear as shown in FIG. 2, together with the information for the auditory dynamic range as shown in FIGS. 1 and 1A. By utilizing these characteristics, the hearing aid device can then be programmed for the individual in a prescription-like basis.

More particularly, in FIG. 4 there is shown a schematic block diagram of the device of this invention, including band pass filters 401 designed to perform the frequency transformation function 301 performed by the human ear; processing circuits 403, 404, 405, and 406 which are designed to perform the respective model processing functions (302, 303, 304, and 305) performed by the normal (nonhearing-impaired) ear, thereby to mimic the mapping of the input audio signal into the perceptual space of the individual; the perceptual space indicated in FIG. 4 is modeled to be identical to the perceptual space 306 in FIG. 3; (the signals produced by the saturation circuit 406 are modeled to be the same signals produced by the saturation circuit 305 in FIG. 3); processing circuits 407, 408 and 409 which are designed to perform corrective functions to compensate for the specific hearing impairment of the individual; and reconstruction filter 410 designed to recombine the processed signals in the various frequency bands for application to the ear. Again, attention is called to the fact that these signals represent the model of the signals at the input ot the afferent auditory nerve fibers as perceived by a "normal" hearing population. To better understand the operation of this system, the following definitions are provided.

The band pass filters 401 are identical to the frequency transducer 301 in FIG. 3. Likewise, the circuits 403, 404, 405 and 406 are identical to the circuits 302, 303, 304 and 305, respectively, of FIG. 3.

By way of further elaboration of the operation of the embodiment shown in FIG. 4, in the processing circuit 403, a value $H_1(k)$ is assigned to the kth output of frequency transformation performed by filters 401. The value is determined in the same fashion described relative to Eq. 1 supra.

Again, it is assumed that the input hearing aid transducer has a response of unity as a function of frequency. If such is not the case, $H_1(k)$ must be further multiplied by the inverse of the gain factor of the transducer at the frequency of the corresponding spectral channel. The value of $H_1(k)$ predetermined for each frequency band k is then multiplied by the output signal produced by each band pass filter and the product applied to the processing circuit 404.

In processing circuit 404, a logarithm to the base 10 is performed on each of the parallel outputs or channels of circuit 403. (Other bases of the logarithm may be chosen with appropriate modification of $H_2(k)$). It should be noted that upon multiplication with $H_2(k)$, circuit 404 performs an effective change of logarithmic base.

In processing circuit 405, a value $H_2(k)$ is assigned to the kth output of circuit 404. The value $H_2(k)$ is a nonlinear function of k and is obtained from the Fletcher-Munson contours of equal loudness for "normal" hearing populations shown in FIG. 1 in the same fashion as Eq. 2 supra.

The signals produced by the processing circuit 405, in each frequency band, are applied to the saturation circuit 406, which performs a clipping function depending upon the level of the output signal in each frequency band. First, if the output of the kth channel is less than zero (i.e. negative), then the output of circuit 406 for the kth channel is clipped to be zero. Second, if the output of the kth channel is greater than zero and less than the output of circuit 405 when the input to $H_2(k)$ is at "LDL" the output of circuit 406 is made equal to the output of the kth channel of circuit 405. Third, if the output of the kth channel of circuit 405 is greater than LDL, the output of the kth channel of circuit 406 is set equal to the saturation level (LDL).

In the processing or recruitment stage 407, a value $\overline{H}_2(k)$ is assigned to the kth output of saturation circuit 406. The value $\overline{H}_2(k)$ is a non-linear function of k and is obtained from the contours of equal loudness fitted for and obtained from the hearing impaired individual using a standard Bekesy audiometric test.

The value of the Bekesy test produces an output plot similar to FIG. 1, but is obtained for the specific individual tested. The value $\overline{H}_2(k)$ is obtained from the conventional Bekesy test output plot by (1) selecting the frequency which corresponds to the index k; (2) reading the "Sound Pressure Level (SPL) (decibels)" at the intersection of the selected frequency and the "Loudness Discomfort Level (LDL)" or other desired upper tolerance level value; (3) reading the "Sound Pressure Level (SPL) (decibels)" at the intersection of the selected frequency and the 0 dB loudness level (which is also the Threshold of Hearing, TOH); (4) subtracting the result of step (3) from the result of step (2) and dividing by the desired "LDL" measured in decibels. This calculation is expressed in Eq. 3.

$$H_2(k) = \frac{SPL \text{ at } LDL - SPL \text{ at } TOH}{LDL(\text{dB})} \qquad \text{Eq. 3.}$$

The exponentiation circuit 408 operates upon the discrete signal output of each of the parallel channels of stage 407 and produces a value equal to 10 raised to the numeric value of that discrete signal. As noted above, bases other than 10 may be used with appropriate scaling of the value $H_2$ in Eq. 4 infra.

In the sensitivity circuit 409, a value $\overline{H}_1(k)$ is assigned to the kth outputs of the exponentiation circuit 408. The value $H_1(k)$ is nonlinear function of k and is also obtained from the contours of equal loudness obtained from the hearing imparied individual using a standard Bekesy audiometric test. The value $H_1(k)$ is obtained from Bekesy test output plot by (1) selecting the frequency which corresponds to the index k; (2) reading the "Sound Pressure Level (SPL) (decibels)" at the intersection of the selected frequency and the 0 dB loudness level (TOH); (3) calculating $H_1(k)$ by dividing the result of step (2) by 20 and taking 10 to that power. This calculation is expressed by Eq. 4.

$$H_1(k) = 10^{\frac{SPL(\text{dB})}{(20)}} \qquad \text{Eq. 4.}$$

In Eq. 4 it is assumed that the output hearing aid transducer has a response of unity as a function of frequency. If such is not the case, $\overline{H}_1(k)$ must be further multiplied by the inverse of the gain factor of the transducer at the frequency of the corresponding spectral band.

Figure 5:
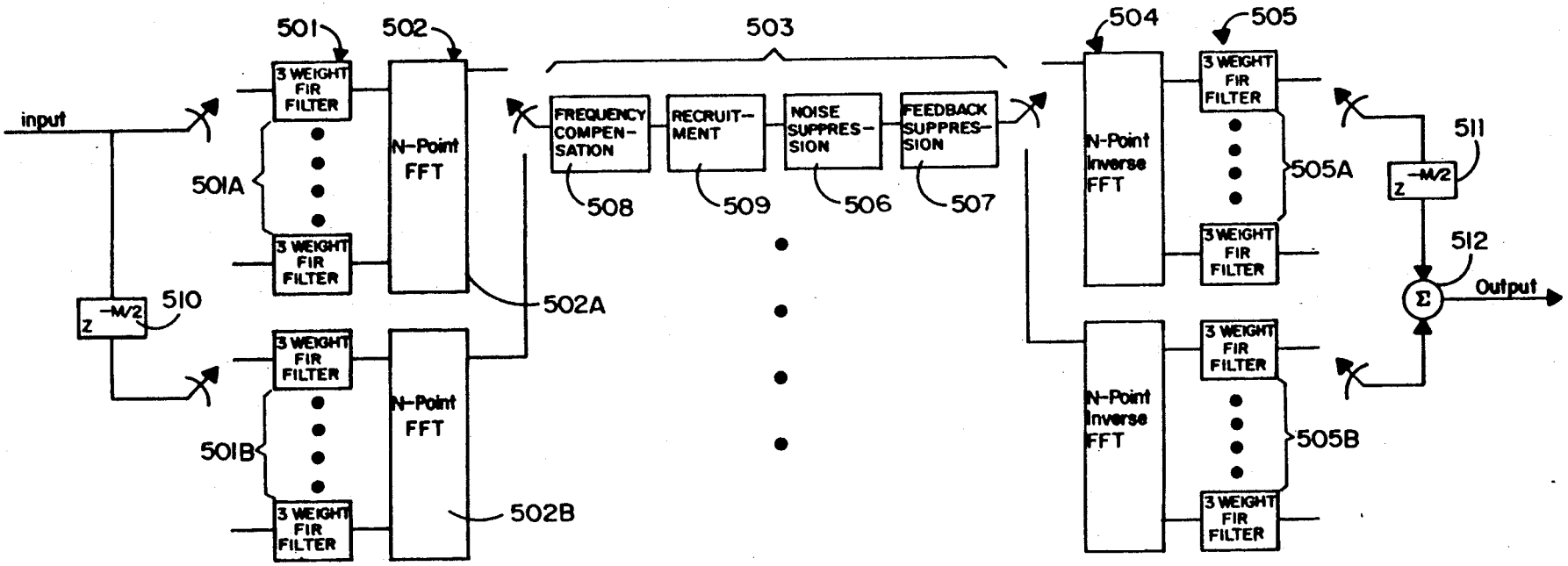
FIG. 5 is a block diagram of a transmultiplexer apparatus of the instant invention.

The reconstruction filter 410 operates on the separate output signals in the spectral domain from circuit 409 and reassembles these signals in the time domain using standard techniques (see Crochiere, Chapter 7, supra) as described infra, relative to the components 504, 505, 505A 505B, 511 and 512 as shown in FIG. 5. More than three "weights" may be employed to further reduce aliasing distortion in the output for severe hearing corrections.

In greater particularity, FIG. 4 shows an apparatus which receives sound wave signals at the input (see arrow) of band pass filter 401. The filter is arranged to produce a plurality of band pass frequencies which are separate and substantially independent. That is, there is little or no overlap of the frequencies in the respective "bins" which are defined by the band pass frequencies. Typically, these filters can be symmetric band pass filters evenly spaced across the bandwidth of the input signal. Likewise, in an efficient implementation the number of filters is an integer power of two. Also, it is assumed that the number of filters (and the respective shapes) provide sufficient frequency resolution such that any desired transfer function can be realized as a weighted sum of the filters. More particularly, the band pass filter 401 performs a frequency transformation which separates the incoming sound represented as a sequence of digital samples into spectral bands, typically 16 to 32 in number. The bandwidth of the kth spectral band is denoted as BW(k). Standard techniques for the design of this frequency transformation device are found in the literature (see Papoulis, pages 176–178 or Crochiere, Chapter 7 for example) and a particularly efficient implementation is shown in FIG. 5.

These multiple band pass signals are then supplied to the processing circuit 403, the logarithmic circuit 404, the recruitment circuit 405 and the saturation circuit 406. These circuits or devices operate in the same fashion as those devices which were described relative to FIG. 3. However, it is noted that the human hearing system 300, i.e., the operational capability of the individual, has previously been tested in accordance with the system shown in FIG. 3. As a consequence, the shortcomings or impairments in the hearing process have been detected and appropriate compensation can now be made. This compensation can be made by inserting inverting networks into the hearing aid system. For convenience, the inverting networks are designated by a barred symbol, e.g., $\overline{H}_1$. Thus, an inverse recruitment stage 407 is used to provide compensation for the recruitment stage 405. The output of the recruitment stage 407 is supplied to the exponentiating circuit 408 which has the effect of compensating or negating the log circuit 404.

In similar function, the sensitivity circuit 409 is the inverse of sensitivity circuit 403 and compensates for the operation of processing circuit 403.

The output of the system includes a reconstruction device 410, which is, of course, the inverse of the base banded band pass filter 401 noted above. The reconstruction device 410 re-combines all of the band pass filter signals and supplies the ultimate combined sound signal. This output is used as the hearing enhancement device 100.

Additionally, digital signal processing techniques for feedback suppression and/or noise suppression are also applied to the signal. Application of these techniques is most effective at the output of the recruitment circuit 405 or the saturation circuit 406, but may be used at the output of processing circuit 403 or log circuit 404. Previous techniques for noise suppression have applied these algorithms to the unprocessed acoustic signal and have provided an output with a muffling effect, thereby reducing the intelligibility of speech signals. Recent noise suppression algorithms have attempted to correct for this muffling effect. Specific embodiments of the noise suppression and feedback suppression are described as part of the invention. A further property of the processing described is that linear phase may be retained to allow binaural processing.

It has been determined that the precise order of the processing circuits between the input filter 401 and the reconstruction or output filter 410 can be varied. Moreover, one or more of these processing operations can be omitted if desired or required for some purpose. However, by removing one or more of the processing circuits, the signal processing ability of the system is reduced, whereupon the output signal supplied is also reduced in content.

Referring now to FIG. 5, there is shown a block diagram of a transmultiplexer system 500 which performs in accordance with the instant invention. As shown in FIG. 5, the transmultiplexer 500 is, essentially, comprised of five component portions including the input pre-filtering stage 501, N-Point Fast Fourier Transform 502 which performs the time-to-frequency transforms (TFT), the processing blocks in the transform space 503, N-Point Fast Fourier Transform 504 which performs the frequency-to-time transforms (FTT or inverse TFT) 504, and the output post-filtering stage 505. The processing blocks include a noise supression stage 506, a feedback supression stage 507, a frequency compensation stage 508 and a recruitment stage 509.

The transmultiplexer 500 operates on the basis of an algorithm which transforms a time signal to its frequency representation at stages 501 and 502, allows independent processing between frequency bins in the transform space 503, and then transforms the frequency representation back into a time signal (stages 504 and 505). In the digital hearing aid, the transmultiplexer is used to maximize the homomorphic processing potential in the transform space 503 by assuring that the bins in the transform space are essentially independent.

In general, an FFT (Fast Fourier Transform) includes a computationally efficient algorithm for obtaining the frequency representation of a time signal. The output of an N point FFT is N frequency bins, each approximating the amplitude of the time signal in that frequency range. However, the value in a particular frequency bin is not a function of the energy at that frequency alone, but, rather, there is a significant interaction between the actual energies in several adjacent bins. Inasmuch as the values in the bins are not independent, one bin cannot be scaled without affecting other frequency bins when the inverse FFT function is performed. In a preferred embodiment, the transmultiplexer algorithm uses two overlapped FFT's, as well as input and output filtering, to decrease dependence between frequency bins. The frequency bins do not overlap significantly with bins adjacent thereto.

As stated, two overlapped FFT's are required in this implementation of the transmultiplexer. In this embodiment, the inputs to each FFT 502A and 502B are the outputs of two separate input filter banks 501A and 501B, respectively. The input filter banks have the same coefficients but the input signal supplied to one of the banks (e.g. bank 501B) is passed through delay network 510 and, thus, delayed by half the number of filters in the banks. In particular, where N is the number of filters in the banks, the input to bank 501B is delayed by N/2 samples.

The output filters are the same as the input filters except that the filter coefficients are arranged in a different order. These coefficients are provided by a different sampling of the window function noted below. Also, the output signal from filter bank 505A is passed through delay 511 and delayed by N/2 and then added to the output signal of filter bank 505B at summing junction 512 to yield the processed transmultiplexer output. Thus, the system accomplishes an overlap-and-add structure. The inputs to the two output filter banks 505A and 505B are the outputs of the two overlapped inverse FFTs 504A and 504B. The algorithms of FFT 502 and inverse FFT 505 are well documented in the literature and need not be discussed here. It should be noted that, in a preferred embodiment, the actual computations required in the transforms, as well as the computations in the intermediate processing blocks, can be cut in half by taking advantage of the symmetry of the FFT.

As shown in FIG. 5, a variety of functions can be performed on the signals in the transform space 503. These operations include noise suppression, feedback suppression, frequency compensation or equalization, and recruitment. Inasmuch as each of these operations can be performed as a separate function, different combinations and arrangements thereof can be used in order to correct for specific hearing disorders in the context of the human hearing system model 300. FIG. 5 presents an optimum system in which all of the above mentioned operations are included.

Figure 6:
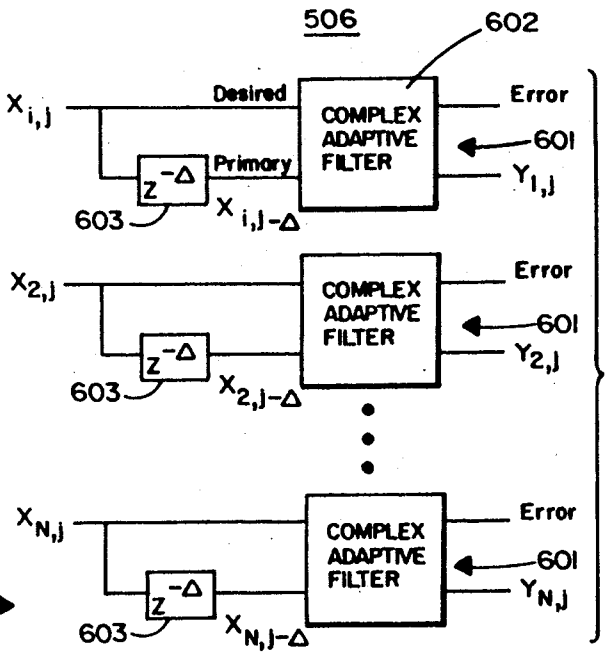
FIG. 6 is a block diagram of a noise suppression device with a delay in the transform domain, which can be used with the instant invention.

There are many ways to implement noise suppression, in particular a frequency domain adaptive noise suppressor. One implementation of a noise suppressor 506 is shown in FIG. 6. The noise suppressor comprises a bank of adaptive filters 601. Each of the adaptive filters includes a FIR filter 602 with feedback 603. There is one filter per bin thereby realizing the symmetry savings noted above. Each filter 601 may include a different $\mu$ forming a vector $\mu$ when considering all filters in the filter bank. The vector $\mu$ permits control of the adaptation times in the frequency bins. If noise suppression is employed at the input to band pass filter 401 or processing circuit 403, in the system of FIG. 4, then the $\mu$ for each frequency region will be different to allow equal adaptation times. If noise suppression is applied at the output of the functions 403, 405 or 406, then a single $\mu$ can suffice. These adaptation times can be experimentally determined and an optimized $\mu$ can be found for each embodiment. The bulk delay 603 incorporates a delay time $Z^{-\Delta}$ and is used to decorrelate the "primary" input to the filter with the "desired" response. The delay time, $\Delta$, in this embodiment is equivalent to $\Delta \times N/2$ samples. This permits noise suppression in the adaptive filter.

Referring now to FIG. 6A there is shown a schematic representation of one of the filters used in the input and output filters banks of the 3-weight Finite Impulse Response (FIR) filters 505 shown in FIG. 5. The output of one of the filters is given by the simple equation:

$$\begin{aligned}\text{Output}(j) &= (a + bZ^{-1} + cZ^{-1})\text{Input}(j)\\ &= a \cdot \text{Input}(j) + b \cdot \text{Input}(j-1) + c \cdot \text{Input}(j-2)\end{aligned}$$

where a, b, and c are constant filter coefficients, the subscript j indicates sample j and $Z^{-1}$ is the standard notation for a unit sample delay. These coefficients are selected as noted above.

The coefficients for the filters are samples from a window function which modifies the input signal so the bins in the sample space will not overlap. Any window function can be used so long as the function insures that the bins are not aliased. The decimation of the input signal depends on the number of FIR filters in the filter bank. For example, in a filter bank with 16 filters, every 16th sample would be gated to a particular filter, i.e. filter 1 receives samples 1, 17 and 33, and so forth.

Alternatively, as shown in FIG. 7, the noise supressor 506 can also be implemented by inserting the delay 703 between the inputs of the filter banks. Mathematically, this puts the delay in the time domain, and requires transforming this delayed signal into the transform domain. The delayed input signal is transformed in the same manner as the undelayed signal with two overlapped FFT's 701, 702 preceeded by two FIR filters 704, 705. The input to the delayed signal filter bank 706, 707 is delayed by $\Delta$ samples from the main input. The output of the delay FFT's 708, 709 is then used as the primary input to the noise suppressor 725 which is a representative circuit arrangement. The output is Y.

With this method of noise supression, each frequency bin is multiplied by some attenuation factor $A_k(m)$. This attenuation factor is determined from the smoothed power (i.e. the average power in the bin) and the estimated noise power in each bin. The attenuation factor is determined by the frequency bin, the sample number, the estimated noise power, the smoothed power, and the square of the magnitude of the amplitude in the selected frequency bin. The circuit follows the equations:

$$A_k(m) = 1 - [N_k^2(m)/X_k^2(m)] \text{ and}$$

$$N_k^2(m) = X_k^2(m) - P_k^2(m)$$

where k denotes the frequency bin, m denotes the sample number, $N_k^2$ is the estimated noise power, $X_k^2$ is the smoothed power, and $P_k^2$ is the square of the magnitude of the amplitude in frequency bin k.

The implementation shown in FIG. 7 requires six FFT's per block (N samples) as compared to four FFT's per block when the bulk delay $\Delta$ in FIG. 7 is transformed into the transform space 503. In this embodiment, the delay time is equivalent to $\Delta$ samples in the time domain. This will create a real-time performance requirement due to an increase in computation as compared to the system using four FFT's.

Another method of noise supression is shown in FIG. 8. This embodiment assumes a constant noise value in each of the frequency bins. Typically, this value is set to 1. The constant value C is the primary input to the adaptive filter 800. This type of noise supression is also called spectral subtraction.

The methods of noise suppression described herein use the same basic adaptive filter which is well known in the art (as are the output and update equations thereof).

Referring now to FIG. 9, there is shown a schematic diagram for one embodiment of the feedback supression stage 507. The feedback suppression function is produced by a feedback suppressor comprised of an adaptive filter 901 governed by the same equations as the noise suppressor. However, the bulk feedback delay 902 for the feedback suppressor 507 is greater than the delay for the noise suppressor and is chosen to decorrelate speech. Typically, the delay is about 100 milliseconds. Also, the output of the feedback suppressor is defined by the Error signal.

FIG. 10 is a schematic representation of one frequency compensation network. The frequency compensation stage 508 corrects the frequency spectrum of the input signal from the band pass filters 401, for example. The exact correction required for the frequency spectrum is determined for each individual. Typically, this function will be measured by audiologists. In its simplest form, the equalization is performed by multiplying the output of each frequency bin by some scale factor K which is the frequency correction scaler for specified transform bin. The various scale factors K will be selected for each individual thereby assuring a good "prescription" fit.

Figure 11:
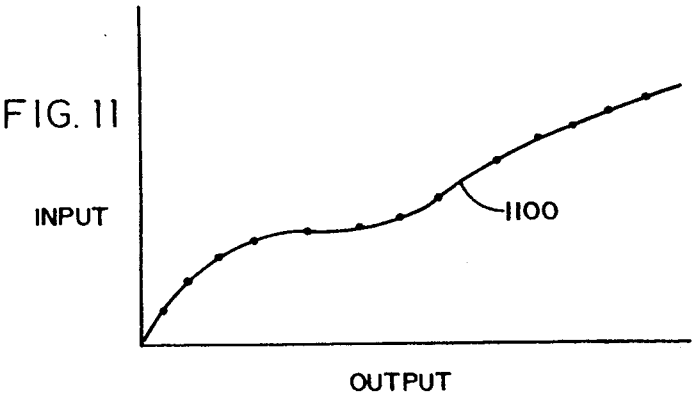
FIG. 11 is a graphic representation of a recruitment characteristic as related to a "look-up table" which can be used with the instant invention.

FIG. 11 is a graphic representation of a typical recruitment characteristic 1100 for an individual. Recruitment is the phenomenon which accounts for the nonlinearity of an individual's perception to a linear change in sound amplitude. Recruitment is a means by which the transform bin power is mapped into a region bounded by the threshold of hearing and the threshold-of-discomfort. This mapping of the bins is inherently non-linear and may be accomplished in several ways, One appropriate approach is through a "table lookup", with one table for each bin. The table contents are scale factors, much like the frequency equalization scale factors, and are determined by individual testing. The sample curve in FIG. 11 is not intended to represent any specific characteristic. However, the several points on the curve are representative of the information which will be stored in the look-up table. Thus, when a particular "input" is received, the recruitment device 509, for example, will produce the appropriate "output". This output will be appropriate to enhance the individual's hearing within the prescribed dynamic range. Thus, the actual hearing capability of the user is enhanced and optimized.

Thus, there is shown and described a new and unique approach to the concept of hearing enhancement. By this approach physically impaired hearing can be improved. Also, hearing which is "environmentally impaired" can be improved. This approach uses the technique of testing the individual to determine what enhancements are required or desired.

In this description, several specific circuits or devices are suggested. These generally use the minimum mean square spectral error filter criterion. However, other types and designs of such circuits are contemplated. Such alternative designs are within the knowledge of those skilled in the art. For example, the band pass filtered signal can be frequency shifted if desired. However, any such modifications or alternatives which fall within the scope of this description are intended to be included therein as well.

Thus, the specific embodiments shown and described herein are intended to be illustrative only, and are not intended to be limitative. Rather, the scope of the invention is limited only by the claims appended hereto.

We claim:

1. A transmultiplexer for use with a hearing enhancement device comprising, a bank of band pass filters,
noise suppression means,
feedback suppression means,
frequency compensation means,
recruitment means, and
recombiner means, said recruitment means includes table look up means for storing signals therein which signals are representative of a hearing characteristic of a user of said hearing enhancement device, said noise suppression means, said feedback suppression means, said frequency compensation means, and said recruitment means connected together in series between said bank of band pass filter means and said recombiner means whereupon an input signal which was filtered into a plurality of signal bands by said bank of band pass filters is recombined at said recombiner means into a single output signal after being operated upon by the series connected components.

2. The transmultiplexer recited in claim 1 including, frequency equalization means connected to said frequency compensation means.

3. The transmultiplexer recited in claim 2 wherein, said equalization means includes at least one multiplier means connected to receive an output from said frequency compensation means and to multiply said output by a scale factor signal.

4. The transmultiplexer recited in claim 1 wherein, said noise suppression means comprises at least one frequency domain adaptive filter means.

5. The transmultiplexer recited in claim 4 wherein, said frequency domain adaptive filter means comprises finite impulse response filter means with feedback.

6. The transmultiplexer recited in claim 5 wherein, said feedback comprises a delay means.

7. The transmultiplexer recited in claim 1 wherein, said frequency compensation means comprises multiplier means for multiplying the output from each of said bank of band pass filters by a specified signal value.

8. The transmultiplexer recited in claim 7 wherein, said specified signal value is a constant.

9. The transmultiplexer recited in claim 1 wherein, said bank of band pass filters is evenly spaced across the bandwidth of an input signal.

10. The transmultiplexer recited in claim 1 wherein, each of said band pass filters is symmetric.

11. A digital hearing enchancement device comprising:

(a) means for converting an input signal into a plurality of spectral values obtained for a plurality of separate bands;

(b) non-linear model means of the hearing system for normal hearing which takes each of said spectral values and creates an output representative of the signal presented to the brainstem of a normal hearing individual, said non-linear model means characterized by;

(i) a frequency response which is not a linear function of frequency and is dependent upon the definition for normal hearing but not dependent upon fitting any specific individual; and (ii) several output channels representing the value of the spectrum at each of the several frequencies and whose output at each frequency is not a linear function of the input at that same frequency;

(c) inverse non-linear model means of the hearing system specifically fitted to a hearing impairment which transforms a modeled "normal" brainstem signal spectrum to an output designed to enhance the hearing of the fitted individual;

said inverse linear model means characterized by;

(i) a frequency response which is not a linear function of frequency and is dependent upon the specific hearing response of the individual to be fitted; and (iii) whose output spectrum is not linearly related to the input to the model in the corresponding spectral region; and (d) means for reassembling the spectral information into a single output signal.

12. The device recited in claim 11 including, means for extracting the parameters of the non-linear model means from the standard Fletcher-Munson contours of equal loudness.

13. The device recited in claim 11 including, means for measuring the parameters used in the inverse non-linear model of the hearing impairment from a standard audiometric Bekesy test.

14. The device recited in claim 11 including, at least one of noise supression means and feed back suppression means.

15. A hearing system which is composed of two of the devices recited in claim 11, a first one of said devices adapted to be fitted to the right ear and a second one of said devices adapted to be fitted to the left ear, wherein each of the said first and second devices possesses linear phase characteristics in order to enhance binaural hearing.

16. A digital hearing enhancement device comprising, frequency transducer means for converting an input signal into a plurality of spectral bands, first transfer function means for producing a first non-linear transfer function of each of said spectral bands, first logarithmic means for producing a logarithmic version of each of said first non-linear function produced by said first transfer function means, second transfer function means for producing a second non-linear transfer function of each of said logarithmic versions of each of said first non-linear transfer functions, and saturation circuit means for producing output signals representative of the magnitude of the second non-linear transfer function produced by said second transfer function means.

17. The device recited in claim 16 including, third transfer function means connected to receive output signals produced by said saturation circuit means and to produce a third non-linear transfer function of each thereof, exponentiation circuit means for producing exponentiated signals which are defined by a specified base number raised to the exponent derived from each of said third non-linear transfer function, fourth transfer function means for producing a fourth non-linear transfer function of each of the exponentiation signals, and reconstruction filter means for reassembly of the spectral band signals from said fourth transfer function means into time domain signals.

18. The device recited in claim 17 wherein, said reconstruction filter means includes a plurality of multiweight FIR filters.

* * * * *